US012544635B2

(12) United States Patent
Nakano

(10) Patent No.: US 12,544,635 B2
(45) Date of Patent: Feb. 10, 2026

(54) GOLF CLUB SHAFT

(71) Applicant: SUMITOMO RUBBER INDUSTRIES, LTD., Kobe (JP)

(72) Inventor: Takashi Nakano, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 790 days.

(21) Appl. No.: 17/882,768

(22) Filed: Aug. 8, 2022

(65) Prior Publication Data

US 2023/0073965 A1 Mar. 9, 2023

(30) Foreign Application Priority Data

Aug. 26, 2021 (JP) ..... 2021-137724

(51) Int. Cl.
*A63B 53/10* (2015.01)
*A63B 53/04* (2015.01)

(52) U.S. Cl.
CPC ..... *A63B 53/10* (2013.01); *A63B 53/0466* (2013.01)

(58) Field of Classification Search
CPC ..... A63B 53/10
See application file for complete search history.

(56) References Cited

U.S. PATENT DOCUMENTS 7,048,645 B2 * 5/2006 Kumamoto ..... A63B 60/54 473/319
2023/0073965 A1 * 3/2023 Nakano ..... A63B 53/0475

FOREIGN PATENT DOCUMENTS

JP 9-38254 A 2/1997
JP 2014-61107 A 4/2014

* cited by examiner

*Primary Examiner* — Magdalena Topolski
(74) *Attorney, Agent, or Firm* — Birch, Stewart, Kolasch & Birch, LLP

(57) ABSTRACT

A shaft includes a tip end and a butt end. In the shaft, a flexural rigidity at a point located 130 mm apart from the tip end is denoted by E1, a flexural rigidity at a point located 1030 mm apart from the tip end is denoted by E10, and a torsional rigidity at the point located 130 mm apart from the tip end is denoted by G1. A ratio (E10/E1) is greater than or equal to 2.4 and less than or equal to 8. The flexural rigidity E1 is less than or equal to 2.5 (kgf·m$^2$). The flexural rigidity E10 is greater than or equal to 6.0 (kgf·m$^2$). The torsional rigidity G1 is greater than or equal to 0.5 (kgf·m$^2$). A ratio (E1/G1) is greater than or equal to 1.0 and less than or equal to 4.0.

12 Claims, 6 Drawing Sheets

GOLF CLUB SHAFT

CROSS REFERENCE TO RELATED APPLICATION

This application claims priority to Japanese Patent Application No. 2021-137724 filed on Aug. 26, 2021. The entire contents of this Japanese Patent Application are hereby incorporated by reference.

BACKGROUND

Technical Field

The present disclosure relates to golf club shafts.

Description of the Related Art

Physical properties of a golf club shaft, such as flexural rigidity and torsional rigidity, can vary depending on positions of the golf club shaft. The performance of the shaft can be changed by the distribution of such physical properties.

JPH09-38254A discloses a golf club shaft in which: a rigidity ratio GJ/EI calculated by dividing a torsional rigidity GJ by a flexural rigidity EI increases by 0.1% or greater as the position in the shaft is shifted by 10 mm toward a tip end of the shaft.

SUMMARY

A shaft that is excellent in feeling and flight distance performance is preferable. A shaft having a good feeling is easy to swing and brings swing stability and good hitting results. The inventor of the present disclosure has found that a new design regarding flexural rigidity and torsional rigidity can improve performance of shafts.

One example of the preset disclosure is to provide a golf club shaft that is excellent in feeling and flight distance performance for golfers who swing a golf club at a relatively high head speed.

A golf club shaft according to one aspect includes a tip end and a butt end. A flexural rigidity EI at a point located 130 mm apart from the tip end is denoted by E1, a flexural rigidity EI at a point located 1030 mm apart from the tip end is denoted by E10, and a torsional rigidity GJ at the point located 130 mm apart from the tip end is denoted by G1. A ratio (E10/E1) is greater than or equal to 2.4 and less than or equal to 8. The flexural rigidity E1 is less than or equal to 2.5 (kgf·m$^2$). The flexural rigidity E10 is greater than or equal to 6.0 (kgf·m$^2$). The torsional rigidity G1 is greater than or equal to 3.5 (kgf·m$^2$). A ratio (E1/G1) is greater than or equal to 1.0 and less than or equal to 4.0.

DESCRIPTION OF THE PREFERRED EMBODIMENTS

Embodiments of the present disclosure will be described in detail below with reference to the drawings as necessary.

The term "layer" and the term "sheet" are used in the present disclosure. The "layer" is a term used for after being wound. In contrast, the "sheet" is a term used for before being wound. The "layer" is formed by winding the "sheet". That is, the wound "sheet" forms the "layer".

In the present disclosure, the same symbol is used in the layer and the sheet. For example, a layer formed by a sheet s1 is referred to as a Layer s1.

In the present disclosure, the term "axial direction" means the axial direction of a shaft. In the present disclosure, the term "circumferential direction" means the circumferential direction of a shaft. Unless otherwise described, the term "length" in the present disclosure means a length in the axial direction. Unless otherwise described, the term "position" in the present disclosure means a position in the axial direction.

Figure 1:
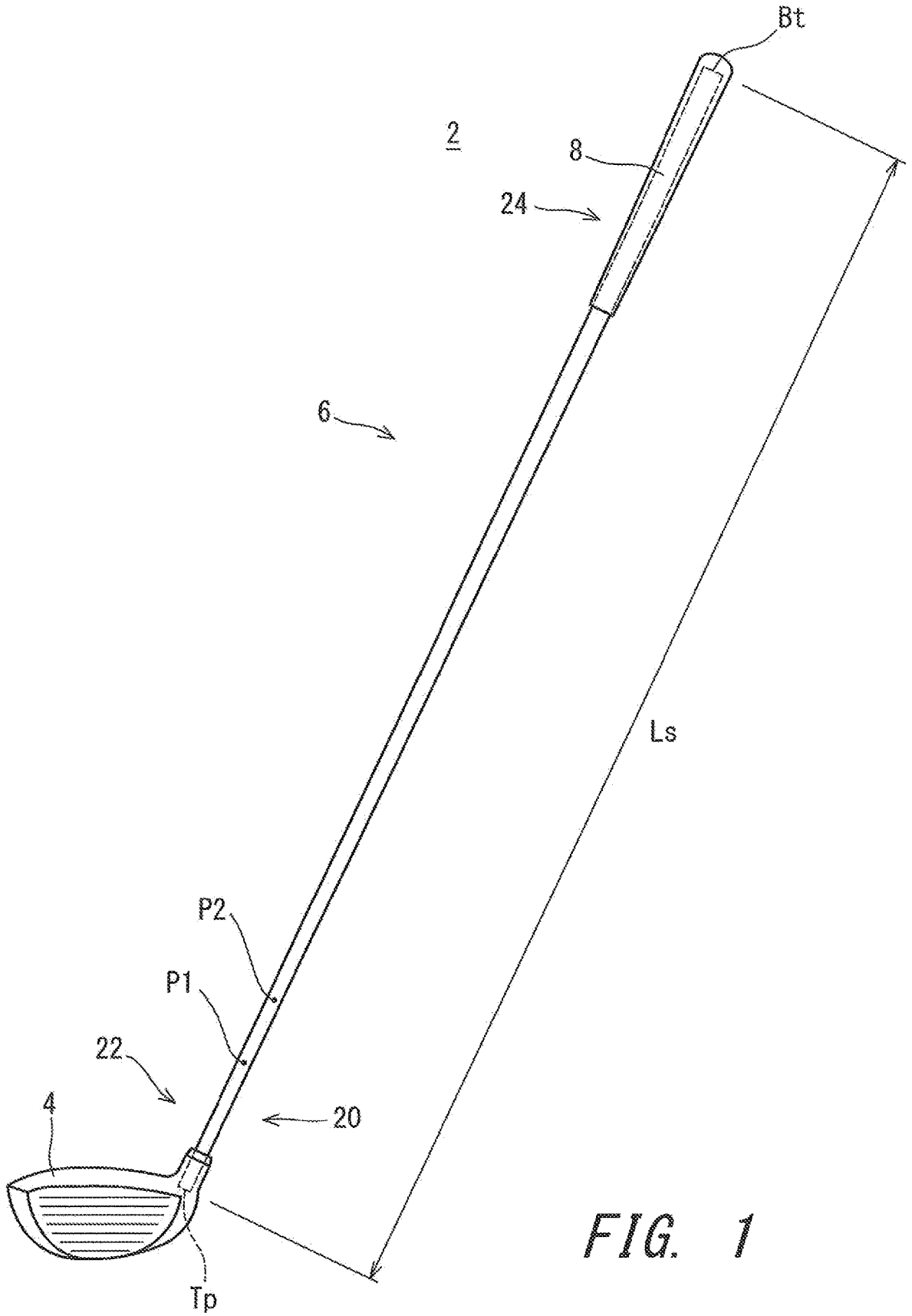
FIG. 1 shows an overall view of a golf club that includes a golf club shaft according to a first embodiment.

FIG. 1 shows a golf club 2 in which a golf club shaft 6 according to the present disclosure is attached. The golf club 2 includes a head 4, the shaft 6, and a grip 8. The head 4 is provided at a tip portion of the shaft 6. The grip 8 is provided at a butt portion of the shaft 6. The shaft 6 is a shaft for a wood type club. The golf club 2 is a driver (number 1 wood). The shaft 6 is a shaft used for drivers.

There is no limitation or the head 4 and the grip 8. Examples of the head 4 include a wood type head, a utility type head, an iron type head, and a putter head. In the present embodiment, the head 4 is a wood type head.

The shaft 6 is formed by a plurality of fiber reinforced resin layers. The kind of fibers is not limited. In the present embodiment, a carbon fiber reinforced resin layer and a glass fiber reinforced resin layer are used as the fiber reinforced resin layers. The shaft 6 is in a tubular form. Although not shown in the drawings, the shaft 6 has a hollow structure. The shaft 6 includes a tip end Tp and a butt end Bt. In the golf club 2, the tip end Tp is located inside the head 4. In the golf club 2, the butt end Bt is located inside the grip 8.

A double-pointed arrow Ls in FIG. 1 shows the length of the shaft 6. This length Ls is measured in the axial direction.

The shaft 6 is formed by winding a plurality of prepreg sheets. In the prepreg sheets, fibers are oriented substantially in one direction. Such a prepreg in which fibers are oriented substantially in one direction is also referred to as a UD prepreg. The term "UD" stands for unidirectional. The prepreg sheets may be made of a prepreg ether than UD prepreg. For example, fibers contained in the prepreg sheets may be woven. In the present disclosure, the prepreg sheet(s) is/are also simply referred to as a sheet(s).

Each prepreg sheet contains fibers and a resin. The resin is also referred to as a matrix resin. Carbon fibers and glass fibers are exemplified as the fibers. The matrix resin is typically a thermosetting resin.

Examples of the matrix resin in the prepreg sheet include a thermosetting resin and a thermoplastic resin. From the viewpoint of shaft strength, the matrix resin is preferably a thermosetting resin, and more preferably an epoxy resin.

The shaft 6 is manufactured by a sheet-winding method. In the prepreg, the matrix resin is in a semi-cured state. In the shaft 6, the prepreg sheets are wound and cured. This "cured" means that the semi-cured matrix resin is cured. The curing process is achieved by heating. The manufacturing processes of the shaft 6 includes a heating process. The heating process cures the matrix resin in the prepreg sheets.

Figure 2:
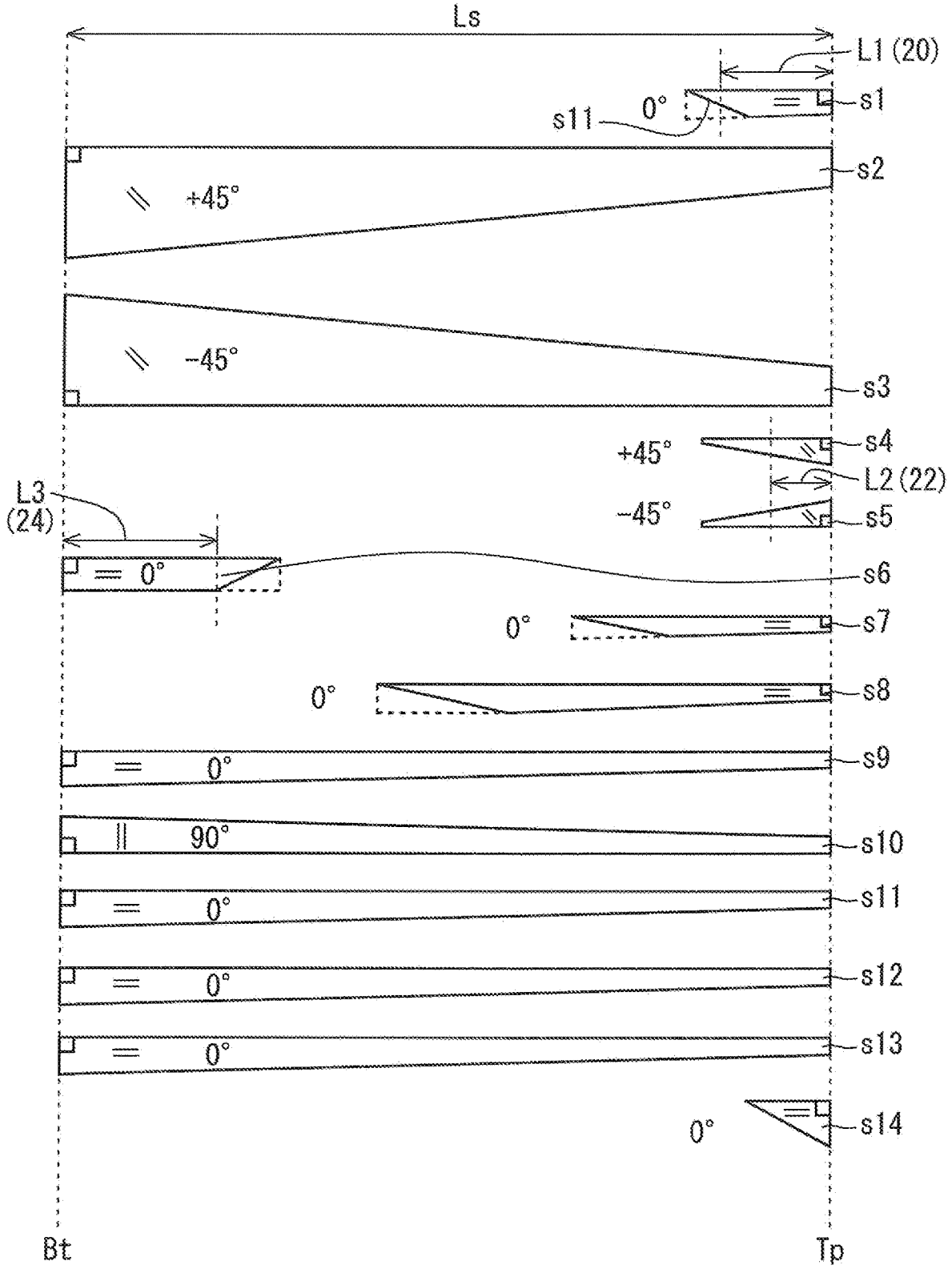
FIG. 2 is a developed view of the golf club shaft in FIG. 1.

FIG. 2 is a developed view of prepreg sheets constituting the shaft 6. FIG. 2 shows the sheets constituting the shaft 6. The shaft 6 is constituted by the plurality of sheets. In the embodiment of FIG. 2, the shaft 6 is constituted by 14 sheets. The shaft 6 includes a first sheet s1 to a fourteenth sheet s14. The developed view shows the sheets constituting the shaft in order from the radial inside of the shaft. The sheets are wound in order from the sheet located on the uppermost side in the developed view. In FIG. 2, the horizontal direction of the figure coincides with the axial direction of the shaft. In FIG. 2, the right side of the figure is the tip side of the shaft. In FIG. 2, the left side of the figure is the butt side of the shaft.

FIG. 2 shows not only the winding order of the sheets but also the position of each of the sheets in the axial direction. For example, in FIG. 2, an end of the sheet s1 is located at the tip end Tp.

The shaft 6 includes a straight layer, a bias layer, and a hoop layer. An orientation angle of the fibers (hereinafter referred to as fiber orientation angle) is described for each of the sheets in FIG. 2. A sheet described as "0°" is a straight sheet. The straight sheet forms the straight layer.

The straight layer is a layer in which the fiber orientation angle is substantially set to 0° with respect to the axial direction. Usually, the fiber orientation may not completely be parallel to the shaft axial direction due to an error in winding, for example. In the straight layer, an absolute angle of the fiber orientation angle with respect to the shaft axis line is less than or equal to 10°. The absolute angle means an absolute value of an angle (fiber orientation angle) formed between the shaft axis line and the orientation of fibers. That is, "the absolute angle is less than or equal to 10°" means that "the fiber orientation angle is greater than or equal to −10 degrees and less than or equal to 4-10 degrees".

In the embodiment of FIG. 2, sheets (straight sheets) that form straight layers are the sheet s1, the sheet s6, the sheet s7, the sheet s8, the sheet s9, the sheet s11, the sheet s12, the sheet s13 and the sheet s14. The straight layers make a great contribution to flexural rigidity and flexural strength.

The bias layer is a layer in which the fiber orientation is substantially inclined with respect to the axial direction. The bias layer makes a great contribution to torsional rigidity and torsional strength. Preferably, bias layers are constituted by a pair of two sheets (herein after referred to as a sheet pair) in which fiber orientation angles of the respective sheets are inclined inversely to each other. Preferably, the sheet pair includes: a layer having a fiber orientation angle of greater than or equal to −60° and less than or equal to −30°; and a layer having a fiber orientation angle of greater than or equal to 30° and less than or equal to 60°. That is, the absolute angle in the bias layers is preferably greater than or equal to 30° and less than or equal to 60°.

In the shaft 6, sheets (bias sheets) that form the bias layers are the sheet s2, the sheet s3, the sheet s4 and the sheet s5. The sheet s2 and the sheet s3 constitute a sheet pair (a first sheet pair). The sheet s4 and the sheet s5 constitute a sheet pair (a second sheet pair). Each sheet pair is wound in a state where the sheets constituting the sheet pair are stuck together. The shaft 6 includes a plurality of (two) sheet pairs.

In FIG. 2, the fiber orientation angle is described for each sheet. The plus sign (+) and minus sign(−) used with the fiber orientation angle indicate inclined direction of the fibers. A sheet having a plus fiber orientation angle and a sheet having a minus fiber orientation angle are combined in each sheet pair. In each sheet pair, fibers in respective sheets are inclined inversely to each other.

The hoop layer is a layer that is disposed so that the fiber orientation substantially coincides with the circumferential direction of the shaft. Preferably, in the hoop layer, the absolute angle of the fiber orientation angle is substantially set to 90° with respect to the shaft axis line. However, the fiber orientation angle to the shaft axial direction may not be completely set to 90° due to an error in winding, for example. In the hoop layer, the absolute angle of the fiber orientation angle is usually greater than or equal to 80° and less than or equal to 90°.

The hoop layer makes a great contribution to crushing rigidity and crushing strength of a shaft. The crushing rigidity means a rigidity against crushing deformation. The crushing deformation means a deformation caused by a crushing force that is applied to the shaft inward in the radial direction of the shaft. In a typical crushing deformation, the cross section of the shaft is deformed from a circular shape to an elliptical shape. The crushing strength means a strength against the crushing deformation.

In the embodiment of FIG. 2, a prepreg sheet (hoop sheet) that constitutes the hoop layer is the sheet s10. The hoop layer s10 is sandwiched between the straight layer s9 and the straight layer s11.

For manufacturing the shaft 6 shown in FIG. 2, a united sheet is used. The united sheet is formed by sticking a plurality of sheets together.

In the embodiment of FIG. 2, three united sheets are used. A first united sheet is the combination of the sheet s2 and the sheet s3. A second united sheet is the combination of the sheet s4 and the sheet s5. A third united sheet is the combination of the sheet s9 and the sheet s10.

As described above, in the present disclosure, the sheets and the layers are classified by the fiber orientation angle. Furthermore, in the present disclosure, the sheets and the layers are classified by their length in the axial direction.

A layer disposed over an entire length in the axial direction of the shaft is referred to as a full length layer. A sheet disposed over an entire length in the axial direction of the shaft is referred to as a full length sheet. A wound full length sheet forms a full length layer. On the other hand, a layer partly disposed in the axial direction of the shaft is referred to as a partial layer. A sheet partly disposed in the axial direction of the shaft is referred to as a partial sheet. A wound partial sheet forms a partial layer.

A layer that is the bias layer and the full length layer is referred to as a full length bias layer. A layer that is the straight layer and the full length layer is referred to as a full length straight layer. A layer that is the hoop layer and the full length layer is referred to as a full length hoop layer.

In the embodiment of FIG. 2, the full length bias layers are formed by the sheet s2 and the sheet s3. The full length straight layers are formed by the sheet s9, the sheet s11, the sheet s12, and the sheet s13. The shaft 6 includes the plurality of full length straight layers s9, s11, s12 and s13. The full length hoop layer is formed by the sheet s10. The shaft 6 includes the full length hoop layer s10 sandwiched between the full length straight layers s9 and s11.

A layer that is the bias layer and the partial layer is referred to as a partial bias layer. A layer that is the straight layer and the partial layer is referred to as a partial straight layer. A layer that is the hoop layer and the partial layer is referred to as a partial hoop layer.

In the embodiment of FIG. 2, the partial bias layers are formed by the sheet s4 and the sheet s5. The partial straight layers are formed by the sheet s1, the sheet s6, the sheet s7, the sheet s8 and the sheet s14. A partial hoop layer is not provided.

The sheet s4 and the sheet s5 are tip partial bias layers. The tip partial bias layers s4 and s5 are disposed in the tip portion of the shaft 6. One ends of the respective tip partial bias layers s4 and s5 are located at the tip end Tp. The shaft 6 does not include a butt partial bias layer.

The sheet s1, the sheet s7, the sheet s8 and the sheet s14 are tip partial straight layers. The tip partial straight layers are disposed in the tip portion of the shaft 6. One ends of the respective tip partial straight layers are located at the tip end Tp.

The sheet s6 is a butt partial straight layer. The butt partial straight layer is disposed in the butt portion of the shaft 6. One end of the butt partial straight layer is located at the butt end Bt.

Hereinafter, the outline of manufacturing processes of the shaft 6 will be described.

[Outline of Manufacturing Processes of Shaft]

(1) Cutting Process

Prepreg sheets are cut into respective desired shapes in the cutting process. Each of the sheets shown in FIG. 2 is cut out in this process.

The cutting may be performed by a cutting machine or may be manually performed. In the manual case, a cutter knife is used, for example.

(2) Sticking Process

In the sticking process, each united sheet described above is produced by sticking a plurality of sheets together. In the sticking process, heating and/or pressing step(s) ray be carried out.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheets are wound around the mandrel. The tacking resin facilitates the application of the end part of a sheet to the mandrel.

A wound body is obtained in the winding process. The wound body is obtained by winding the prepreg sheets around the outside of the mandrel. For example, the winding is achieved by rolling the object to be wound on a plane. The winding may be manually performed or may be performed by a machine. The machine is referred to as a rolling machine.

(4) Tape Wrapping Process

A tape is wrapped around the outer circumferential surface of the wound body in the tape wrapping process. The tape is also referred to as a wrapping tape. The wrapping tape is helically wrapped while tension is applied to the tape so that there is no gap between adjacent windings. The wrapping tape applies pressure to the wound body. The pressure contributes to reduction of voids.

(5) Curing Process

In the curing process, the wound body after being subjected to the tape wrapping is heated. The heating cures the matrix resin. In the curing process, the matrix resin fluidizes temporarily. The fluidization of the matrix resin can discharge air from between the sheets or in each sheet. The fastening force of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel.

(7) Process of Cutting Off Both Ends

Both end portions of the cured laminate are cut off in the process. The cutting off flattens the end face of the tip end Tp and the end face of the butt end Bt.

(8) Polishing Process

The surface of the cured laminate is polished in the process. Spiral unevenness is present on the surface of the cured laminate as the trace of the wrapping tape. The polishing removes the unevenness to smooth the surface of the cured laminate.

(9) Coating Process

The cured laminate after the polishing process is subjected to coating.

The shaft 6 has a flexural rigidity at each position in the axial direction. A flexural rigidity (or its value) is also referred to as EI. In the present disclosure, the unit of EI is "kgf·m$^2$".

Figure 3:
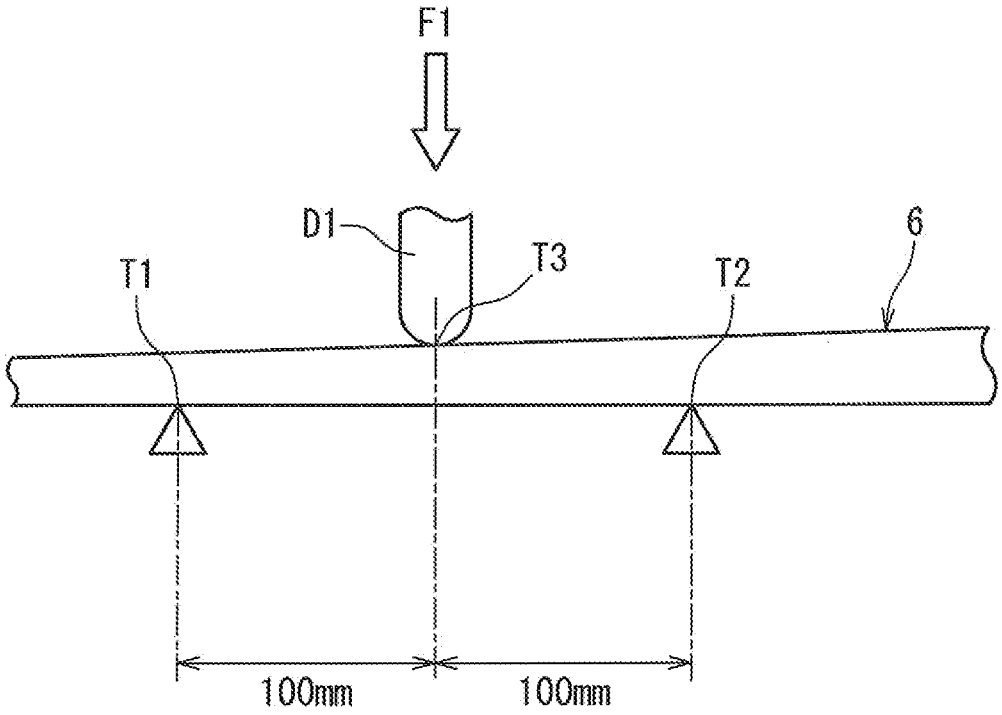
FIG. 3 is a schematic diagram illustrating a method for measuring a flexural rigidity EI.

FIG. 3 shows the method for measuring EI. As a measuring device, a universal testing machine "model 2020 (maximum load: 500 kg)" produced by Intesco Co., Ltd. can be used. The shaft 6 is supported from below at a first supporting point T1 and at a second supporting point T2. In the state where the shaft 6 is supported, a load F1 is applied at a measurement point T3 from above. The load F1 is applied vertically downward. The distance between the point T1 and the point T2 is 200 mm. The measurement point T3 is a point that divides the distance between the point T1 and the point T2 into two equal parts. The amount of bending (flexure) H when the Load F1 is applied is measured. The load F1 is applied by an indenter D1. The tip end of the indenter D1 is a cylindrical surface having a radius of curvature of 5 mm. The downwardly moving speed of the indenter D1 is 5 mm/min. When the load F1 reaches 20 kgf (196 N), the indenter D1 is stopped, and the amount of bending H in this state is measured. The amount of bending H is a distance in the vatical direction between the position of the point T3 before the load F1 is applied and the position of the point T3 when the indenter D1 is stopped. EI is calculated by the following formula:

$$EI\ (\text{kgf}\cdot\text{m}^2)=F1\times L^3/(48\times H),$$

where, F1 denotes a maximum load (kgf), L is a distance (m) between the support points, and H is the amount of bending (m). The maximum load F1 is 20 kgf. The distance L between the support points is 0.2 m.

As the measurement points of EI, the following 10 points are exemplified.

(Measurement point 1): a point located 130 mm apart from the tip end Tp (Measurement point 2): a point located 230 mm apart from the tip end Tp (Measurement point 3): a point located 330 mm apart from the tip end Tp (Measurement point 4): a point located 430 mm apart from the tip end Tp (Measurement point 5): a point located 530 mm apart from the tip end Tp (Measurement point 6): a point located 630 mm apart from the tip end Tp (Measurement point 7): a point located 730 mm apart from the tip end Tp (Measurement point 8): a point located 830 mm apart from the tip end Tp (Measurement point 9): a point located 930 mm apart from the tip end Tp (Measurement point 10): a point located 1030 mm apart from the tip end Tp The point located 130 mm apart from the tip end Tp is also referred to as a point P1. This P1 is also used as a reference symbol in drawings (see FIG. 1).

It should be noted that the distances from the tip end Tp for the measurement points are measured in the axial direction. These distances are measured from the tip end Tp toward the butt end Bt.

In the present disclosure, EI at the measurement point 1 is denoted by E1. EI at the measurement point 2 is denoted by E2. EI at the measurement point 3 is denoted by E3. EI at the measurement point 4 is denoted by E4. EI at the measurement point 5 is denoted by E5. EI at the measurement point 6 is denoted by E6. EI at the measurement point 7 is denoted by E7. EI at the measurement point 8 is denoted by E8. EI at the measurement point 9 is denoted by E9. EI at the measurement point 10 is denoted by E10. The unit of E1 to E10 is kgf·m$^2$. For specifying the values of E1 to E10, the values can be rounded off to the first decimal place.

Figure 4:
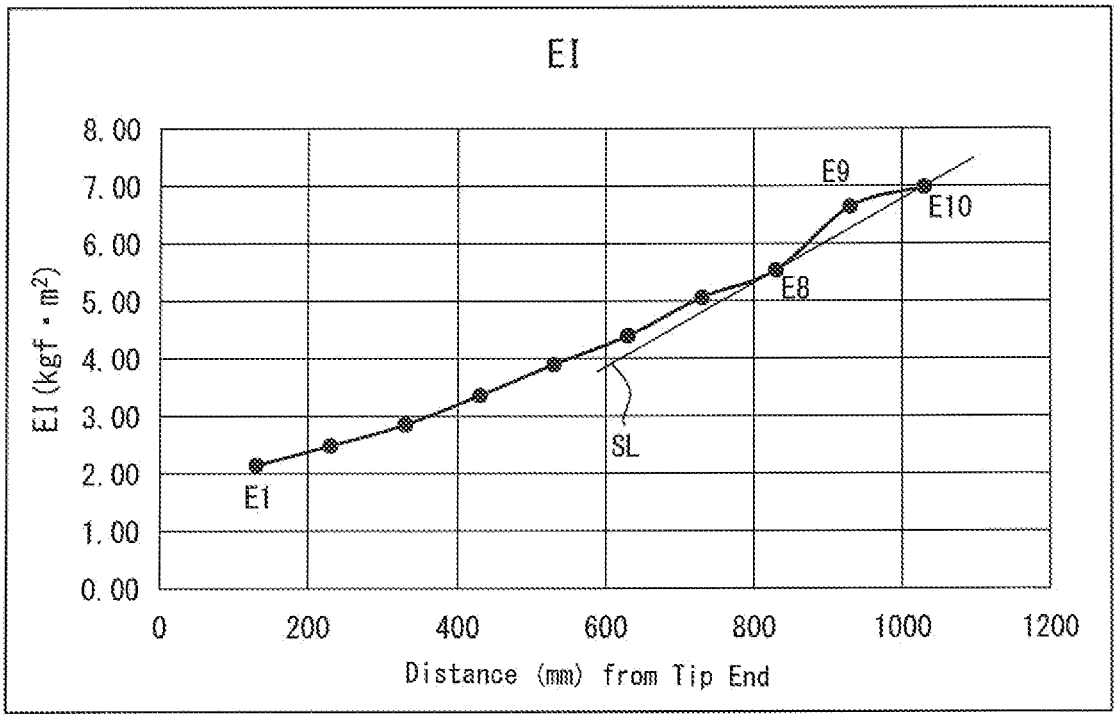
FIG. 4 shows a graph on an orthogonal coordinate system having a horizontal axis (x-axis) that represents a distance (mm) from a tip end and a vertical axis (y-axis) that represents a flexural rigidity EI (kgf·m$^2$), this graph showing EI distribution of Example 1.

FIG. 4 shows a graph on an orthogonal coordinate system having an x-axis that represents a distance (mm) from the tip end and a y-axis that represents a flexural rigidity (kgf·m$^2$). FIG. 4 is a graph showing the distribution of flexural rigidities EI in Example 1 explained below. In this graph, the following 10 points having respective coordinates (x, y) are plotted.

Point (130, E1)

Point (230, E2)

Point (330, E3)

Point (430, E4)

Point (530, E5)

Point (630, E6)

Point (730, E7)

Point (830, E8)

Point (930, E9)

Point (1030, E10)

For the sake of easy explanation, the point (130, E1) is also referred to as a point E1. The point (230, E2) is also referred to as a point E2. The point (330, E3) is also referred to as a point E3. The point (430, E4) is also referred to as a point E4. The point (530, E5) is also referred to as a point E5. The point (630, E6) is also referred to as a point E6. The point (730, E7) is also referred to as a point E7. The point (830, E8) is also referred to as a point E8. The point (930, E9) is also referred to as a point E9. The point (1030, E10) is also referred to as a point E10.

The shaft 6 has a torsional rigidity at each position in the axial direction. A torsional rigidity (or its value) is also referred to as GJ. In the present disclosure, the unit of GJ is "kgf·m$^2$".

Examples of the measurement points of GJ includes a point located 90 mm apart from the tip end Tp and a point located 140 mm apart from the tip end Tp. When GJ at a point located 90 mm apart from the tip end Tp is denoted by Ga, GJ at a point located 140 mm apart from the tip end Tp is denoted by Gb, and GJ at the point P1 located 130 mm apart from the tip end Tp is denoted by G1, then G1 can be calculated by the following formula with proportion calculation:

$$G1=[(Gb-Ga)/50]\times 40+Ga.$$

Figure 5:
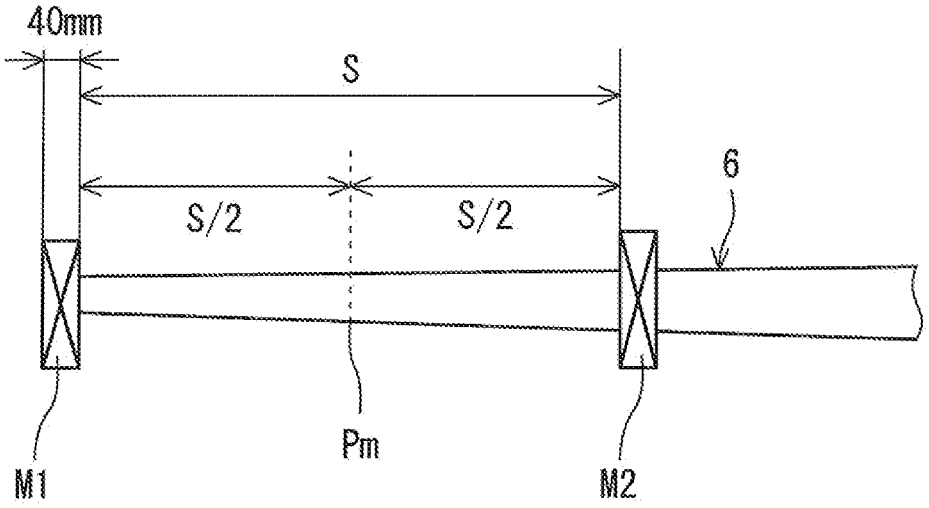
FIG. 5 is a schematic diagram illustrating a method for measuring a torsional rigidity GJ.

FIG. 5 shows a method for measuring a torsional rigidity GJ at a measurement point Pm. A first position is fixed by a jig M1, and a second position located S (m) apart from the jig M1 is held by a jig M2. The jig M1 holds the shaft 6 with a width of 40 mm. The span S is adjusted depending on the measurement point. In a measurement of GJ at the point located 90 mm apart from the tip end Tp, the span S is set to 0.1 m (100 mm). In a measurement of GJ at the point located 140 mm apart from the tip end Tp, the span S is set to 0.2 m (200 mm). The measurement point Pm is a point by which the distance between the first position and the second position is divided into two equal parts. A torsion angle A of the shaft 6 when a torque Tr of 0.139 (kgf·m$^2$) is applied from the jig F2 to the shaft 6 is measured. The torsional rigidity GJ is calculated by the following formula:

$$GJ\ (\text{kgf}\cdot\text{m}^2)=S\times Tr/A,$$

where, S denotes a measuring span (m); Tr denotes a torque (kgf·m); and A denotes a torsion angle (radian). The torque Tr is 0.139 (kgf·m).

Figure 6:
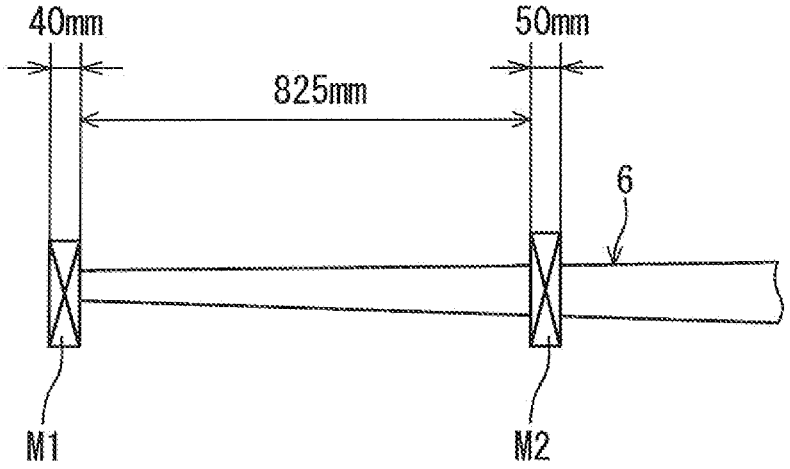
FIG. 6 is a-schematic diagram illustrating a method for measuring a shaft torque.

FIG. 6 is a schematic diagram showing a method for measuring a shaft torque. A portion between the tip end Tp and a point located 40 mm apart from the tip end Tp is fixed by a jig M1. This fixing is achieved by an air chuck, and the air pressure of the air chuck is 2.3 kgf/cm$^2$. A jig M2 is fixed to a portion of the shaft extending from a position located 825 mm apart from the jig M1 toward the butt end Bt and having a width of 50 mm. This fixing is achieved by an air chuck, and the air pressure of this air chuck is 1.5 kgf/cm$^2$. The jig M2 is rotated while the jig M1 is fixed, and a torque Tr of 0.139 kgf·m is applied to the shaft 6. A torsion angle caused by this torque Tr is the shaft torque. The smaller the shaft torque is, the greater the torsional rigidity of the shaft 6 as a whole is.

A reduction in the shaft torque enhances the directional stability of hit balls. The greater the flight distance is, the greater the deviation of the hit ball in the left-right direction with respect to a target direction is. It is important for competitive golfers who wish to achieve a greater flight distance to reduce the shaft torque. From this viewpoint, the shaft torque is preferably less than or equal to 4.0°, more preferably less than or equal to 3.9°, and still more preferably less than or equal to 3.8°. An excessively large number of bias layers increases the weight of the shaft. From this viewpoint, the shaft torque is preferably greater than or equal to 2.8°, more preferably greater than or equal to 2.9°, and still more preferably greater than or equal to 3.0°.

[E10/E1, E1, E10]

As described above, the flexural rigidity E1 at the point P1 located 130 mm apart from the tip end Tp, and the flexural rigidity E10 at the point located 1030 mm apart from the tip end Tp are measured. A shaft having a greater ratio (E10/E1) of E10 to E1 has a high flexural rigidity EI in the butt portion of the shaft 6 and a low flexural rigidity EI in the tip portion of the shaft 6.

A shaft having a great E10/E1 has a high flexural rigidity at a position close to the grip 8 and gives solid feel to golfers, thereby improving feeling. In addition, in such a shaft, bending occurs in the tip portion of the shaft 6. As a result, the shaft 6 is stabilized even when swung strongly, and recovery from bending of the tip portion of the shaft improves head speed. Particularly for competitive golfers who swing a driver at a head speed of greater than or equal to 40 m/s and wish to achieve a great flight distance, this shaft contributes to improvement in feeling and increase in flight distance.

It should be noted that the recovery from bending means that bent shaft returns to an unbent state after the shaft is bent such that the head delays with respect to the travel direction of a swing. The recovery from bending in downswing increases head speed.

Thus, an increased E10/E1 improves feeling and increases head speed immediately before impact. From this viewpoint, E10/E1 is preferably greater than or equal to 2.4, more preferably greater than or equal to 2.6, still more preferably greater than or equal to 2.8, still more preferably greater than or equal to 3.0, and yet still more preferably greater than or equal to 3.2. An excessively great E10/E1 can make the butt portion of the shaft 6 too rigid, which may lead to deterioration in feeling and/or can make the tip portion of the shaft 6 too flexible, which may lead to an insufficient recovery from bending. From this viewpoint, E10/E1 is preferably less than or equal to 8.0, more preferably less than or equal to 7.0, still more preferably less than or equal to 6.0, and yet still more preferably less than or equal to 5.0.

From the viewpoint of increasing the degree of bending in the tip portion of the shaft 6 and increasing head speed by recovery from bending, the flexural rigidity E1 is preferably less than or equal to 2.5 (kgf·m$^2$), more preferably less than or equal to 2.4 (kgf·m$^2$), and still more preferably less than or equal to 2.3 (kgf·m$^2$). An excessively small E1 can cause an insufficient recovery from bending. From this viewpoint, the flexural rigidity E1 is preferably greater than or equal to 1.6 (kgf·m$^2$), more preferably greater than or equal to 1.8 (kgf·m$^2$), and still more preferably greater than or equal to 2.0 (kgf·m$^2$).

From the viewpoint of feeling and bending of the tip portion of the shaft 6, E10 is preferably greater than or equal to 6.0 (kgf·m$^2$), more preferably greater than or equal to 6.2 (kgf·m$^2$), still more preferably greater than or equal to 6.4 (kgf·m$^2$), still more preferably greater than or equal to 6.6 (kgf·m$^2$), and yet still more preferably greater than or equal to 6.8 (kgf·m$^2$). An excessively great E10 can make the butt portion of the shaft 6 too rigid, which may lead to deterioration in feeling. From this viewpoint, E10 is preferably less than or equal to 8.0 (kgf·m$^2$), more preferably less than or equal to 7.8 (kgf·m$^2$), and still more preferably less than or equal to 7.6 (kgf·m$^2$).

As shown in the graph of FIG. 4, the greater the distance from the tip end Tp is, the greater the value of EI (E1 to E10) is. In this graph, the rate of change between two points adjacent to each other is greatest at between the point E8 and the point E9.

E10 is greater than E9. E9 is greater than E8. As shown in the graph of FIG. 4, however, the graph forms a projection at and near the point E9. The point E9 is located above a straight line SL that connects the point E8 and the point E10. A ratio [(E9−E8)/(E10−E9)] of a difference (E9−E8) to a difference (E10−E9) is greater than 1. A higher flexural rigidity E9 further improves the above-described solid feel, which gives good feeling to golfers. From this viewpoint, the ratio [(E9−E8)/(E10−E9)] is greater than or equal to 2.0, more preferably greater than or equal to 2.5, and still more preferably greater than or equal to 3.0. An excessively greater E9 gives a stiff feeling to golfers, which can cause deterioration in feeling. From this viewpoint, the ratio [(E9−E8)/(E10−E9)] is less than or equal to 5.0, more preferably less than or equal to 4.5, and still more preferably less than or equal to 4.0.

[G1]

As described above, the torsional rigidity GJ at the point P1 located 130 mm apart from the tip end Tp is denoted by G1.

An increased G1 increases torsional rigidity of the tip portion of the shaft 6. When a head collides against a ball at impact, the tip portion of the shaft 6 can be so twisted as to open the face of the head 4. This phenomenon is also referred to as "impact-induced shaft twisting". This impact-induced shaft twisting decreases rebound performance and reduces the initial velocity of the hit ball. By suppressing the impact-induced shaft twisting, rebound performance is enhanced and flight distance is improved. From the viewpoint of suppressing the impact-induced shaft twisting, G1 is preferably greater than or equal to 0.5 (kgf·m$^2$), more preferably greater than or equal to 0.55 (kgf·m$^2$), still more preferably greater than or equal to 0.60 (kgf·m$^2$), and yet still more preferably greater than or equal to 0.65 (kgf·m$^2$). An excessively great G1 can cause deterioration in feel at impact. From this viewpoint, G1 is preferably less than or equal to 0.85 (kgf·m$^2$), more preferably less than or equal to 0.80 (kgf·m$^2$), and still more preferably less than or equal to 0.75 (kgf·m$^2$).

[E1/G1]

E1/G1 is a ratio of the flexural rigidity EI to the torsional rigidity GJ at the point P1. From the viewpoint of increasing head speed by recovery from bending of the tip portion of the shaft 6 and from the viewpoint of suppressing the impact-induced shaft twisting, E1/G1 is preferably less than or equal to 4.0, more preferably less than or equal to 3.7, still more preferably less than or equal to 3.3, and yet still more preferably less than or equal to 3.1. An excessively small E1/G1 can cause a too small E1, which may lead to an insufficient recovery from bending, and/or can cause a too large G1, which may lead to deterioration in feel at impact. From this viewpoint, E1/G1 is preferably greater than or equal to 1.0, more preferably greater than or equal to 1.5, still more preferably greater than or equal to 2.0, and still more preferably greater than or equal to 2.5.

As described above, the shaft 6 is formed by a plurality of fiber reinforced resin layers and includes straight layers and bias layers.

In the shaft 6, the total number N1 of plies of the bias layers at the point P1 located 130 mm apart from the tip end Tp is less than or equal to 3.5. As shown in FIG. 2, bias layers in the shaft 6 is the layer s2, the layer s3, the layer s4 and the layer s5. The total number of plies of these layers is less than or equal to 3.5 plies. When, at the point P1, the number of plies of the layer s2 is denoted by p2, the number of plies of the layer s3 is denoted by p3, the number of plies of the layer s4 is denoted by p4, and the number of plies of the layer s5 is denoted by p5, then the total number N1 of plies is p2+p3+p4+p5. The number of plies means the number of windings (turns) of a wound layer. For example, the number of plies of a layer that is wound by two turns (720°) is 2.0. For example, the number of plies of a layer that is wound by 1.5 turns (540°) is 1.5.

By suppressing the total number N1 of plies while disposing the tip partial bias layers s4 and s5, the shaft can be lightweight and have a smaller shaft torque. From this viewpoint, the total number N1 of plies is preferably less than or equal to 3.5, more preferably less than or equal to 3.4, and still more preferably less than or equal to 3.3. From the viewpoint of reducing shaft torque, the total number N1 of plies is preferably greater than or equal to 2, more preferably greater than or equal to 2.2, and still more preferably greater than or equal to 2.4. Note that, in Example 1 to be described below, the total number N1 of plies was 3.0.

In the shaft 6, the total thickness T1 of the bias layers at the point P1 located 130 mm apart from the tip end Tp is less than or equal to 0.23 mm. As shown in FIG. 2, the bias layers in the shaft 6 are the layer s2, the layer s3, the layer s4, and the layer s5. The sum total of thicknesses of these layers is less than or equal to 0.23 mm. When, at the point P1, the thickness of the layer s2 is denoted by t2, the thickness of the layer s3 is denoted by t3, the thickness of the layer s4 is denoted by t4, and the thickness of the layer s5 is denoted by t5, then the total thickness T1 is t2+t3+t4+t5. For example, when the thickness of the prepreg constituting the layer s2 is denoted by R and the number of plies of the layer s2 is 1.5, the thickness t2 of the Layer s2 is the product of these values, that is, 1.5×R.

By suppressing the total thickness T1 while disposing the tip partial bias layers s4 and s5, the shaft can be lightweight and have a smaller shaft torque. From this viewpoint, the total thickness T1 is preferably less than or equal to 0.23 mm, more preferably less than or equal to 0.22 mm, and still more preferably less than or equal to 0.21 mm. From the viewpoint of reducing shaft torque, the total thickness T1 is preferably greater than or equal to 0.13 mm, more preferably greater than or equal to 3.14 mm, and still more preferably greater than or equal to 0.16 mm. Note that, in Example 1 to be described below, the total thickness T1 was 0.20 mm.

As shown in FIG. 2, in the shaft 6, the straight layers include: the full length straight layers s9, s11, s12 and s13 disposed over the entire length of the shaft 6; the tip partial straight layers s1, s7, s8 and s14 partly disposed in the tip portion of the shaft 6; and the butt partial straight layer s6 partly disposed in the butt portion of the shaft 6. In the shaft 6, the bias layers include the full length bias layers s2 and s3 disposed over the entire length of the shaft 6, and the tip partial bias layers s4 and s5 partly disposed in the tip portion of the shaft 6.

In the shaft 6, one or more plies of the tip partial bias layers are disposed in a region that extends from the tip end Tp to a point P2 located 200 mm apart from the tip end Tp. That is, when the total number of plies of all the tip partial bias layers s4 and s5 is denoted by N2, N2 is greater than or equal to 1.0 at all positions in the region extending from the point P2 to the tip end Tp.

Note that a point located 200 mm apart from the tip end Tp is also referred to as a point P2. This P2 is also used as a reference symbol in drawings (see FIG. 1).

In the shaft 6, two or more plies of the tip partial straight layers are disposed in the region extending from the tip end Tp to the point P2 located 200 mm apart from the tip end Tp. That is, when the total number of plies of the tip partial straight layers s1, s7, s8, and s14 is denoted by N3, N3 is greater than or equal to 2.0 at all positions in the region extending from the point P2 to the tip end Tp.

In the shaft 6, the butt partial straight layer s6 is disposed in a region that extends from the butt end Bt to a point located 300 mm apart from the butt end Bt. The region extending from the butt end Bt to the point located 300 mm apart from the butt end Bt is also referred to as a butt specific region. The butt partial straight layer s6 is present at all positions in the butt specific region. In FIG. 2, the length in the axial direction of the butt partial straight layer s6 is greater than or equal to 300 mm.

The presence of the butt partial straight layer s6 suppresses an unstable movement of the shaft 6 at swing transition. The swing transition means a moment of transition from the top of a swing to downswing. Further, the butt partial straight layer s6 gives an enhanced solid feel to golfers, thereby improving feeling. From the swing transition until impact, the butt partial straight layer s6 can stabilize the behavior of the shaft 6, improve controllability, and keep the solid feel. From this viewpoint, the length in the axial direction of the butt partial straight layer s6 is preferably greater than or equal to 300 mm, more preferably greater than or equal to 310 mm, still more preferably greater than or equal to 320 mm, and yet still more preferably greater than or equal to 330 mm. From the viewpoint of suppressing the shaft weight, the length in the axial direction of the butt partial straight layer s6 is preferably less than or equal to 500 mm, more preferably less than or equal to 450 mm, and still more preferably less than or equal to 403 mm.

The shaft 6 includes tip partial straight layers s1, s7, s8, and s14. Of these layers, the tip partial straight layer s1 has a fiber elastic modulus of less than or equal to 10 t/mm$^2$, which is referred to as a low elastic tip partial straight layer. As such, in the shaft 6, the tip partial straight layers include the low elastic tip partial straight layer s1 having a fiber elastic modulus of less than or equal to 10 t/mm$^2$. The low elastic tip partial straight layer s1 is the innermost layer of the shaft 6. The low elastic tip partial straight layer s1 does not have to be the innermost layer. The reinforcing fibers of the low elastic tip partial straight layer s1 are not limited, and glass fibers and carbon fibers are exemplified as the reinforcing fibers.

A low elastic tip straight reinforced portion 20 in which two or more plies of the low elastic tip partial straight layer s1 are disposed is formed in the tip portion of the shaft 6 (see FIG. 2). The low elastic tip straight reinforced portion 20 is formed in a region that extends from the tip end Tp to a predetermined position. A double-pointed arrow L1 in FIG. 2 shows the length of the low elastic tip straight reinforced portion 20. In the present embodiment, a portion in which two or more plies of the sheet s1 are wound is the low elastic tip straight reinforced portion 20. As shown in FIG. 2, an oblique side s11 is formed on the butt side of the sheet s1, and the number of plies of the sheet s1 decreases toward the butt side. A boundary from which the number of plies of the sheet s1 becomes less than or equal to 2 is present at a position on the oblique side s11.

The low elastic tip straight reinforced portion 20 suppresses the flexural rigidity of the tip portion of the shaft 6. This can ensure bending of the tip portion, and increase head speed. From this viewpoint, the length L1 of the low elastic tip straight reinforced portion 20 is preferably greater than or equal to 60 mm, more preferably greater than or equal to 100 mm, and still more preferably greater than or equal to 140 mm. From the viewpoint of weight reduction of the shaft 6, the length L1 is preferably less than or equal to 300 mm, more preferably less than or equal to 250 mm, and still more preferably less than or equal to 200 mm.

The shaft 6 includes a high elastic tip partial bias layer. In the shaft 6, all of the tip partial bias layers s4 and s5 are the high elastic tip partial bias layers. Alternatively, some of tip partial bias layers may be the high elastic tip partial bias layer(s). The high elastic tip partial bias layers have a fiber elastic modulus of greater than or equal to 33 t/mm$^2$.

From the viewpoint of reducing the shaft torque, the fiber elastic modulus of the high elastic tip partial bias layers is preferably greater than or equal to 33 t/mm$^2$, more preferably greater than or equal to 37 t/mm$^2$, and still more preferably greater than or equal to 40 t/mm$^2$. From the viewpoint of the strength of the tip portion of the shaft 6, the fiber elastic modulus of the high elastic tip partial bias layers is preferably less than or equal to 70 t/mm$^2$, more preferably less than or equal to 60 t/mm$^2$, and still more preferably less than or equal to 50 t/mm$^2$.

A high elastic tip bias reinforced portion 22 in which two or more plies in total of the high elastic tip partial bias layers s4 and s5 are disposed is formed in the tip portion of the shaft 6 (see FIG. 2). This number of plies is the sum of the number of plies of all the high elastic tip partial bias layers. In the present embodiment, this number of plies is the sum total of the number of plies of the high elastic tip partial bias layer s4 and the number of plies of the high elastic tip partial bias layer s5. The high elastic tip bias reinforced portion 22 is formed in a region that extends from the tip end Tp to a predetermined position. A double-pointed arrow L2 in FIG. 2 shows the length of the high elastic tip bias reinforced portion 22. In the present embodiment, a portion in which the sum total of the number of plies of the sheet s4 and the number of plies of the sheet s5 is greater than or equal to 2 is the high elastic tip bias reinforced portion 22. The sheet s4 and the sheet s5 have a triangular shape, and the number of plies of these sheets decreases toward the butt side. Accordingly, a boundary at which the sum total of the number of plies of the sheet s4 and the number of plies of the sheet s5 becomes less than 2 is present at the above-mentioned predetermined position.

The high elastic tip bias reinforced portion 22 can suppress the flexural rigidity of the tip portion of the shaft 6 and further reduce the shaft torque. From this viewpoint, the length L2 of the high elastic tip bias reinforced portion 22 is preferably greater than or equal to 50 mm, more preferably greater than or equal to 75 mm, and still more preferably greater than or equal to 100 mm. From the viewpoint of weight reduction of the shaft 6, the length L2 is preferably less than or equal to 250 mm, more preferably less than or equal to 225 mm, and still more preferably less than or equal to 200 mm.

As shown in FIG. 2, the shaft 6 includes the first tip partial straight layer s7 and the second tip partial straight layer s8 as tip partial straight layers which are longer than the tip partial bias layers s4 and s5. The second tip partial straight layer s8 is longer than the first tip partial straight layer s7. This configuration alleviates stress concentration caused by bending of the tip portion of the shaft 6, and increases the strength of the shaft 6.

The tip partial straight layer s7 has a thickness of as thin as less than or equal to 0.08 mm. This ensures bending of the tip portion of the shaft 6. From the viewpoint of bending at the tip portion, the thickness of the tip partial straight layer s7 is preferably less than or equal to 0.08 mm, more preferably less than or equal to 0.075 mm, and still more preferably less than or equal to 0.07 mm. From the viewpoint of strength, the thickness of the tip partial straight layer s7 is preferably greater than or equal to 0.04 mm, more preferably greater than or equal to 0.045 mm, and still more preferably greater than or equal to 0.05 mm. Regardless of the position in the axial direction, the number of plies of the layer s7 is substantially 1. The term "substantially" means that the number is preferably greater than or equal to 0.95 and less than or equal to 1.05. The fiber elastic modulus of the layer s7 is less than or equal to 24 t/mm$^2$ (and greater than or equal to 10 t/mm$^2$).

The tip partial straight layer s8 has a thickness of as thin as less than or equal to 0.08 mm. This ensures bending of the tip portion of the shaft 6. From the viewpoint of bending at the tip portion, the thickness of the tip partial straight layer s8 is preferably less than or equal to 0.08 mm, more preferably less than or equal to 0.075 mm, and still more preferably less than or equal to 0.07 mm. From the viewpoint of strength, the thickness of the tip partial straight layer s8 is preferably greater than or equal to 0.04 mm, more preferably greater than or equal to 0.045 mm, and still more preferably greater than or equal to 0.05 mm. Regardless of the position in the axial position, the number of plies of the layer s8 is substantially 1. The term "substantially" means that the number is preferably greater than or equal to 0.95 and less than or equal to 1.05. The fiber elastic modulus of the layer s8 is less than or equal to 24 t/mm$^2$ (and greater than or equal to 10 t/mm$^2$).

The shaft 6 includes, in the tip portion thereof, a portion that is the low elastic tip straight reinforced portion 20 and that is the high elastic tip bias reinforced portion 22. In the shaft 6, the length L1 of the low elastic tip straight reinforced portion 20 is longer than the length L2 of the high elastic tip bias reinforced portion 22 (see FIG. 2). As a result, the length of the portion that is the low elastic tip straight reinforced portion 20 and that is the high elastic tip bias reinforced portion 22 is L2. Alternatively, the length L1 may be shorter than the length L2. The length L1 may be equal to the length L2.

The shaft 6 includes a high elastic butt partial straight layer. In the shaft 6, all of the butt partial straight layer s6 is the high elastic butt partial straight layer. Alternatively, the shaft 6 may include a high elastic butt partial straight layer and a butt partial straight layer other than the high elastic butt partial straight layer. The fiber elastic modulus of the high elastic butt partial straight layer s6 is greater than or equal to 33 t/mm$^2$.

From the viewpoint of the above-described solid feel and feeling of the shaft, the fiber elastic modulus of the high elastic butt partial straight layer is preferably greater than or equal to 33 t/mm$^2$, more preferably greater than or equal to 37 t/mm$^2$, and still more preferably greater than or equal to 40 t/mm$^2$. From the viewpoint of strength of the butt portion of the shaft 6, the fiber elastic modulus of the high elastic butt partial straight layer is preferably less than or equal to 70 t/mm$^2$, more preferably less than or equal to 60 t/mm$^2$, and still more preferably less than or equal to 50 t/mm$^2$.

A high elastic butt straight reinforced portion 24 in which one or more plies of the high elastic butt partial straight layer s6 are disposed is formed in the butt portion of the shaft 6. The high elastic butt straight reinforced portion 24 is formed in a region that extends from the butt end Bt to a predetermined position. A double-pointed arrow L3 in FIG. 2 shows the length of the high elastic butt straight reinforced portion 24. In the present embodiment, a portion in which one or more plies of the sheet s6 are wound is the high elastic butt straight reinforced portion 24.

The high elastic butt straight reinforced portion 24 further enhances the above-described solid feel and improves feeling of the shaft. From this viewpoint, the length L3 of the high elastic butt straight reinforced portion 24 is preferably greater than or equal to 180 mm, more preferably greater than or equal to 200 mm, and still more preferably greater than or equal to 220 mm. From the viewpoint of weight reduction of the shaft 6, the length L3 is preferably less than or equal to 400 mm, more preferably less than or equal to 350 mm, and still more preferably less than or equal to 300 mm.

From the viewpoint of flight distance and feeling, the length Ls of the shaft is preferably greater than or equal to 1080 mm, more preferably greater than or equal to 1130 mm, and still more preferably greater than or equal to 1150 mm. Considering restriction on the club length under the rules of golf, the length Ls of the shaft is preferably less than or equal to 1210 mm, more preferably less than or equal to 1200 mm, and still more preferably less than or equal to 1190 mm.

From the viewpoint of increasing the head speed, the shaft weight is preferably less than or equal to 64.0 g, more preferably less than or equal to 63.0 g, and still more preferably less than or equal to 62.0 g. From the viewpoint of the degree of freedom in design, the shaft weight is preferably greater than or equal to 55.0 g, more preferably greater than or equal to 56.0 g, and still more preferably greater than or equal to 57.0 g.

The following tables show examples of prepregs utilizable in the shaft of the present disclosure.

TABLE 1

Examples of utilizable prepregs

| Manufacturer | Trade name | Thickness of sheet (mm) | Weight per unit area ($g/m^2$) | Fiber content (% by weight) | Resin content (% by weight) | Physical property value of reinforcing fiber: Part number of fiber | Tensile elastic modulus ($t/mm^2$) | Tensile strength ($kgf/mm^2$) |
|---|---|---|---|---|---|---|---|---|
| Toray Industries, Inc. | 3255S-10 | 0.082 | 132 | 76 | 24 | T700S | 24 | 500 |
| Toray Industries, Inc. | 3255S-12 | 0.103 | 165 | 76 | 24 | T700S | 24 | 500 |
| Toray Industries, Inc. | 3255S-15 | 0.123 | 198 | 76 | 24 | T700S | 24 | 500 |
| Toray Industries, Inc. | 2255S-10 | 0.082 | 132 | 76 | 24 | T800S | 30 | 600 |
| Toray Industries, Inc. | 2255S-12 | 0.102 | 164 | 76 | 24 | T800S | 30 | 600 |
| Toray Industries, Inc. | 2255S-15 | 0.123 | 197 | 76 | 24 | T800S | 30 | 600 |
| Toray Industries, Inc. | 2256S-10 | 0.077 | 125 | 80 | 20 | T800S | 30 | 600 |
| Toray Industries, Inc. | 2256S-12 | 0.103 | 156 | 80 | 20 | T800S | 30 | 600 |
| Toray Industries, Inc. | 2276S-10 | 0.077 | 125 | 80 | 20 | T800S | 30 | 600 |
| Toray Industries, Inc. | 805S-3 | 0.034 | 50 | 60 | 40 | M30S | 30 | 560 |
| Toray Industries, Inc. | 8053S-3 | 0.028 | 43 | 70 | 30 | M30S | 30 | 560 |
| Toray Industries, Inc. | 8053S-3A | 0.023 | 36 | 70 | 30 | M30S | 30 | 560 |
| Toray Industries, Inc. | 17045G-10 | 0.082 | 132 | 76 | 24 | T1100G | 33 | 675 |
| Toray Industries, Inc. | 1704EG-7 TC | 0.055 | 92 | 82 | 18 | T1100G | 33 | 675 |
| Toray Industries, Inc. | 1704EG-10 TC | 0.073 | 122 | 82 | 18 | T1100G | 33 | 675 |
| Toray Industries, Inc. | 9255S-7A | 0.056 | 92 | 78 | 22 | M40S | 40 | 470 |
| Toray Industries, Inc. | 9255S-6A | 0.047 | 76 | 76 | 24 | M40S | 40 | 470 |
| Toray Industries, Inc. | 9053S-4 | 0.027 | 43 | 70 | 30 | M40S | 40 | 470 |
| Nippon Graphite Fiber Corporation | E1026A-09N | 0.100 | 151 | 63 | 37 | XN-10 | 10 | 190 |
| Nippon Graphite Fiber Corporation | E1026A-14N | 0.150 | 222 | 63 | 37 | XN-10 | 10 | 190 |

The tensile strength and the tensile elastic modulus are measured in accordance with "Testing Method for Carbon Fibers" JIS R7601: 1986.

TABLE 2

| Examples of utilizable prepregs | | | | | | | | |
|---|---|---|---|---|---|---|---|---|
| | | | | | | Physical property value of reinforcing fiber | | |
| Manufacturer | Trade name | Thickness of sheet (mm) | Weight per unit area ($g/m^2$) | Fiber content (% by weight) | Resin content (% by weight) | Part number of fiber | Tensile elastic modulus ($t/mm^2$) | Tensile strength ($kgf/mm^2$) |
| Mitsubishi Chemical Corporation | GE352H-160S | 0.150 | 246 | 65 | 35 | E glass | 7 | 320 |
| Mitsubishi Chemical Corporation | TR350C-100S | 0.083 | 133 | 75 | 25 | TR50S | 24 | 500 |
| Mitsubishi Chemical Corporation | TR350U-100S | 0.078 | 126 | 75 | 25 | TR50S | 24 | 500 |
| Mitsubishi Chemical Corporation | TR350C-125S | 0.104 | 167 | 75 | 25 | TR50S | 24 | 500 |
| Mitsubishi Chemical Corporation | TR350C-150S | 0.124 | 200 | 75 | 25 | TR50S | 24 | 500 |
| Mitsubishi Chemical Corporation | TR350C-175S | 0.147 | 233 | 75 | 25 | TR50S | 24 | 500 |
| Mitsubishi Chemical Corporation | MR350J-025S | 0.034 | 48 | 63 | 37 | MR40 | 30 | 450 |
| Mitsubishi Chemical Corporation | MR350J-050S | 0.058 | 86 | 63 | 37 | MR40 | 30 | 450 |
| Mitsubishi Chemical Corporation | MR350C-050S | 0.05 | 67 | 75 | 25 | MR40 | 30 | 450 |
| Mitsubishi Chemical Corporation | MR350C-075S | 0.063 | 100 | 75 | 25 | MR40 | 30 | 450 |
| Mitsubishi Chemical Corporation | MRX350C-075R | 0.063 | 101 | 75 | 25 | MR40 | 30 | 450 |
| Mitsubishi Chemical Corporation | MRX350C-100S | 0.085 | 133 | 75 | 25 | MR40 | 30 | 450 |
| Mitsubishi Chemical Corporation | MR350C-100S | 0.085 | 133 | 75 | 25 | MR40 | 30 | 450 |
| Mitsubishi Chemical Corporation | MRX350C-125S | 0.105 | 167 | 75 | 25 | MR40 | 30 | 450 |
| Mitsubishi Chemical Corporation | MRX350C-150S | 0.125 | 200 | 75 | 25 | MR40 | 30 | 450 |
| Mitsubishi Chemical Corporation | MR350C-125S | 0.105 | 167 | 75 | 25 | MR40 | 30 | 450 |
| Mitsubishi Chemical Corporation | MR350E-100S | 0.093 | 143 | 70 | 30 | MR40 | 30 | 450 |
| Mitsubishi Chemical Corporation | HRX350C-075S | 0.057 | 92 | 75 | 25 | HR40 | 40 | 450 |
| Mitsubishi Chemical Corporation | HRX350C-110S | 0.082 | 132 | 75 | 25 | HR40 | 40 | 450 |

The tensile strength and the tensile elastic modulus are measured in accordance with "Testing Method for Carbon Fibers" JIS R7601: 1986.

EXAMPLES

Example 1

A shaft having the same configuration as the shaft 6 was produced in accordance with the above-described manufacturing processes. The structure of sheets of the shaft was as shown in FIG. 2. The length Ls of the shaft was 1168 mm. The shaft weight was 59.0 g. A driver head and a grip were attached to the produced shaft to obtain a golf club. As the driver head, a head of the trade name "SRIXON ZX7 driver" (loft angle 10.5°) manufactured by Sumitomo Rubber Industries, Ltd. was used.

In Example 1, a prepreg having a fiber elastic modulus (tensile elastic modulus) of 40 t/mm$^2$ was used as the high elastic tip partial bias layers s4 and s5. In addition, a prepreg having a fiber elastic modulus (tensile elastic modulus) of 40 t/mm$^2$ was used as the butt partial straight layer s6. Layers other than the tip partial straight layer s1 were carbon fiber reinforced layers, but the tip partial straight layer s1 was a glass fiber reinforced layer. As the glass fiber reinforced layer, a glass fiber reinforced prepreg having a fiber elastic modulus (tensile elastic modulus) of 7 t/mm$^2$ was used.

In Example 1, the length L1 to the length L3 (see FIG. 2) were as follows. The length L1 of the low elastic tip straight reinforced portion 20 in which two or more plies of the low elastic tip partial straight layer s1 are disposed was 150 mm. The length L2 of the high elastic tip bias reinforced portion 22 in which two or more plies in total of the high elastic tip partial bias layers s4 and s5 were disposed was 130 mm. The length L3 of the high elastic butt straight reinforced portion 24 in which one or more plies of the high elastic butt partial straight layer s6 were disposed was 250 mm.

As described above, FIG. 4 is an EI distribution of Example 1. E1 was 2.15 (kgf·m$^2$). E2 was 2.48 (kgf·m$^2$). E3 was 2.85 (kgf·m$^2$). E4 was 3.36 (kgf·m$^2$). E5 was 3.90 (kgf·m$^2$). E6 was 4.40 (kgf·m$^2$). E7 was 5.06 (kgf·m$^2$). E8 was 5.54 (kgf·m$^2$). E9 was 6.64 (kgf·m$^2$). E10 was 6.98 (kgf·m$^2$).

Examples 2 to 6 and Comparative Example 1

Golf clubs of Examples 2 to 6 and Comparative Example 1 were obtained in the same manner as in Example 1 except that the number of plies of each of the tip partial bias layers s4 and s5 and the tip partial straight layers s1, s7 and s8 was adjusted to meet specifications shown in Table 3.

<Measurement of EI and GJ>

EI and GJ were measured by the measurement methods described above. Measured values are shown in Table 3 below.

<Measurement of Flight Distance>

Five competitive golfers who swing a driver at a head speed of 40 m/s or greater and have a handicap from 0 to 10 each hit a ball five times using each of the clubs to measure a flight distance for each shot. The flight distance is a distance to where a ball hit by the club finally arrives, and includes a distance by which the ball runs on the ground. The flight distance shown in Table 3 below is an average value of measured values per club.

<Feeling>

Shaft feeling was also determined in each of the shots for measuring flight distance. The feelings during swing and at impact for each shot were evaluated on a scale of one to five by each golfer. The higher the score is, the better the feeling is. As the golf ball, the trade name "SRIXON Z-STAR XV" manufactured by Sumitomo Rubber Industries, Ltd. was used. The average values of the evaluated scores for respective clubs are shown in below Table 3.

TABLE 3

Specifications and evaluation results of Examples and Comparative Example

| | Unit | Ex. 1 | Ex. 2 | Ex. 3 | Ex. 4 | Ex. 5 | Ex. 6 | Comp. Ex. 1 |
|---|---|---|---|---|---|---|---|---|
| E1 | kgf · m$^2$ | 2.2 | 2.3 | 2.4 | 2.5 | 1.8 | 1.6 | 2.7 |
| E10 | kgf · m$^2$ | 7.0 | 6.8 | 6.6 | 6.4 | 7.6 | 8.0 | 5.7 |
| G1 | kgf · m$^2$ | 0.70 | 0.69 | 0.65 | 0.62 | 0.73 | 0.85 | 0.48 |
| E10/E1 | — | 3.2 | 3.0 | 2.8 | 2.6 | 4.2 | 5.0 | 2.1 |
| E1/G1 | — | 3.1 | 3.3 | 3.7 | 4.0 | 2.5 | 1.9 | 5.6 |
| Total number of plies of bias layers at point P1 | — | 3.0 | 2.8 | 2.4 | 2.0 | 3.3 | 3.5 | 1.5 |
| Total thickness of bias layers at point P1 | mm | 0.20 | 0.18 | 0.16 | 0.13 | 0.21 | 0.23 | 0.10 |
| Shaft torque | degrees | 3.7 | 3.8 | 3.9 | 4.0 | 2.8 | 2.9 | 4.2 |
| Feeling (on a scale of 1 to 5) | — | 5.0 | 4.8 | 4.7 | 4.5 | 4.9 | 4.6 | 4.0 |
| Flight distance | yards | 265 | 262 | 261 | 260 | 263 | 260 | 255 |

As shown in Table 3, Examples are highly evaluated as compared with Comparative Example.

The following clauses are a part of invention included in the present disclosure.

[Clause 1]

A golf club shaft including a tip end and a butt end, wherein when a flexural rigidity EI at a point located 130 mm apart from the tip end is denoted by E1;

a flexural rigidity EI at a point located 1030 mm apart from the tip end is denoted by E10; and a torsional rigidity GJ at the point located 130 mm apart from the tip end is denoted by G1, then a ratio (E10/E1) is greater than or equal to 2.4 and less than or equal to 8, the flexural rigidity E1 is less than or equal to 2.5 (kgf·m$^2$), the flexural rigidity E10 is greater than or equal to 6.0 (kgf·m$^2$), the torsional rigidity G1 is greater than or equal to 0.5 (kgf·m$^2$), and a ratio (E1/G1) is greater than or equal to 1.0 and less than or equal to 4.0.

[Clause 2]

The golf club shaft according to clause 1, wherein the golf club shaft is formed by a plurality of fiber reinforced resin layers, the fiber reinforced resin layers include straight layers and bias layers, a total number of plies of the bias layers at the point located 130 mm apart from the tip end is less than or equal to 3.5, a total thickness of the bias layers at the point located 130 mm apart from the tip end is less than or equal to 0.23 mm, the straight layers include a full length straight layer that is disposed over an entire length of the golf club shaft, a tip partial straight layer that is partly disposed in a tip portion of the golf club shaft, and a butt partial straight layer that is partly disposed in a butt portion of the golf club shaft, the bias layers include a full length bias layer that is disposed over the entire length of the golf club shaft, and a tip partial bias layer that is partly disposed in the tip portion of the golf club shaft, two or more plies of the tip partial straight layer are disposed in a region that extends from the tip end to a point located 200 mm apart from the tip end, one or more plies of the tip partial bias layer are disposed in the region that extends from the tip end to the point located 200 mm apart from the tip end, the butt partial straight layer is disposed in a region that extends from the butt end to a point located 300 mm apart from the butt end, and the golf club shaft has a shaft torque of less than or equal to 4°.

[Clause 3]

The golf club shaft according to clause 2, wherein the tip partial straight layer includes a low elastic tip partial straight layer that has a fiber elastic modulus of less than or equal to 10 t/mm$^2$, and a low elastic tip straight reinforced portion in which two or more plies of the low elastic tip partial straight layer are disposed is formed in the tip portion of the golf club shaft.

[Clause 4]

The golf club shaft according to clause 2 or 3, wherein the tip partial bias layer includes a high elastic tip partial bias layer that has a fiber elastic modulus of greater than or equal to 33 t/mm$^2$, and a high elastic tip bias reinforced portion in which two or more plies of the high elastic tip partial bias layer are disposed is formed in the tip portion of the golf club shaft.

[Clause 5]

The golf club shaft according to any one of clauses 2 to 4, wherein the butt partial straight layer includes a high elastic butt partial straight layer that has a fiber elastic modulus of greater than or equal to 33 t/mm$^2$, and a high elastic butt straight reinforced portion in which one or more plies of the high elastic butt partial straight layer are disposed is formed in the butt portion of the golf club shaft.

[Clause 6]

The golf club shaft according to any one of clauses 2 to 5, wherein the tip partial straight layer includes a first tip partial straight layer that is longer than the tip partial bias layer, and a second tip partial straight layer that is longer than the first tip partial straight layer, the first tip partial straight layer has a thickness of less than or equal to 0.08 mm, and the second tip partial straight layer has a thickness of less than or equal to 0.08 mm.

[Clause 7]

The golf club shaft according to any one of clauses 1 to 6, wherein when a flexural rigidity EI at a point located 830 mm apart from the tip end is denoted by E8; and a flexural rigidity EI at a point located 930 mm apart from the tip end is denoted by E9, then E9 is greater than E8, E10 is greater than E9, and a ratio [(E9−E8)/(E10−E9)] is greater than 1.

LIST OF REFERENCE SYMBOLS

2 Golf club
4 Head
6 Shaft
8 Grip
20 Low elastic tip straight reinforced portion
22 High elastic tip bias reinforced portion
24 High elastic butt straight reinforced portion
s1 to s14 Prepreg sheets (layers)
Bt Butt end
Tp Tip end The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising", "having", "including", and "containing" are to be construed as open-ended terms (i.e., meaning "including, but not limited to,") unless otherwise noted.

What is claimed is:

1. A golf club shaft comprising a tip end and a butt end, wherein a flexural rigidity EI at a point located 130 mm apart from the tip end is denoted by E1, a flexural rigidity EI at a point located 1030 mm apart from the tip end is denoted by E10, a torsional rigidity GJ at the point located 130 mm apart from the tip end is denoted by G1, a ratio (E10/E1) is greater than or equal to 2.4 and less than or equal to 8, the flexural rigidity E1 is less than or equal to 2.5 (kgf·m$^2$), the flexural rigidity E10 is greater than or equal to 6.0 (kgf·m$^2$), the torsional rigidity G1 is greater than or equal to 0.5 (kgf·m$^2$), a ratio (E1/G1) is greater than or equal to 1.0 and less than or equal to 4.0, the golf club shaft is formed by a plurality of fiber reinforced resin layers, the fiber reinforced resin layers include straight layers and bias layers, a total number of plies of the bias layers at the point located 130 mm apart from the tip end is less than or equal to 3.5, a total thickness of the bias layers at the point located 130 mm apart from the tip end is less than or equal to 0.23 mm, the straight layers include a full length straight layer that is disposed over an entire length of the golf club shaft, a tip partial straight layer that is partly disposed in a tip portion of the golf club shaft, and a butt partial straight layer that is partly disposed in a butt portion of the golf club shaft, the bias layers include a full length bias layer that is disposed over the entire length of the golf club shaft, and a tip partial bias layer that is partly disposed in the tip portion of the golf club shaft, two or more plies of the tip partial straight layer are disposed in a region that extends from the tip end to a point located 200 mm apart from the tip end, one or more plies of the tip partial bias layer are disposed in the region that extends from the tip end to the point located 200 mm apart from the tip end, the butt partial straight layer is disposed in a region that extends from the butt end to a point located 300 mm apart from the butt end, and the golf club shaft has a shaft torque of less than or equal to 4°.

2. The golf club shaft according to claim 1, wherein the tip partial straight layer includes a low elastic tip partial straight layer that has a fiber elastic modulus of less than or equal to 10 t/mm$^2$, and a low elastic tip straight reinforced portion in which two or more plies of the low elastic tip partial straight layer are disposed is formed in the tip portion of the golf club shaft.

3. The golf club shaft according to claim 1, wherein the tip partial bias layer includes a high elastic tip partial bias layer that has a fiber elastic modulus of greater than or equal to 33 t/mm$^2$, and a high elastic tip bias reinforced portion in which two or more plies of the high elastic tip partial bias layer are disposed is formed in the tip portion of the golf club shaft.

4. The golf club shaft according to claim 1, wherein the butt partial straight layer includes a high elastic butt partial straight layer that has a fiber elastic modulus of greater than or equal to 33 t/mm$^2$, and a high elastic butt straight reinforced portion in which one or more plies of the high elastic butt partial straight layer are disposed is formed in the butt portion of the golf club shaft.

5. The golf club shaft according to claim 1, wherein the tip partial straight layer includes a first tip partial straight layer that is longer than the tip partial bias layer, and a second tip partial straight layer that is longer than the first tip partial straight layer, the first tip partial straight layer has a thickness of less than or equal to 0.08 mm, and the second tip partial straight layer has a thickness of less than or equal to 0.08 mm.

6. The golf club shaft according to claim 1, wherein a flexural rigidity EI at a point located 830 mm apart from the tip end is denoted by E8; and a flexural rigidity EI at a point located 930 mm apart from the tip end is denoted by E9, E9 is greater than E8, E10 is greater than E9, and a ratio [(E9−E8)/(E10−E9)] is greater than 1.

7. The golf club shaft according to claim 6, wherein the ratio [(E9−E8)/(E10−E9)] is greater than or equal to 2.0.

8. A golf club shaft comprising a tip end and a butt end, wherein the golf club shaft is formed by a plurality of fiber reinforced resin layers, the fiber reinforced resin layers include straight layers and bias layers, a total number of plies of the bias layers at a point located 130 mm apart from the tip end is less than or equal to 3.5, a total thickness of the bias layers at the point located 130 mm apart from the tip end is less than or equal to 0.23 mm, the straight layers include a full length straight layer that is disposed over an entire length of the golf club shaft, a tip partial straight layer that is partly disposed in a tip portion of the golf club shaft, and a butt partial straight layer that is partly disposed in a butt portion of the golf club shaft, the bias layers include a full length bias layer that is disposed over the entire length of the golf club shaft, and a tip partial bias layer that is partly disposed in the tip portion of the golf club shaft, two or more plies of the tip partial straight layer are disposed in a region that extends from the tip end to a point located 200 mm apart from the tip end, one or more plies of the tip partial bias layer are disposed in the region that extends from the tip end to the point located 200 mm apart from the tip end, the butt partial straight layer is disposed in a region that extends from the butt end to a point located 300 mm apart from the butt end, and the golf club shaft has a shaft torque of less than or equal to 4°.

9. The golf club shaft according to claim 8, wherein the tip partial straight layer includes a low elastic tip partial straight layer that has a fiber elastic modulus of less than or equal to 10 t/mm$^2$, and a low elastic tip straight reinforced portion in which two or more plies of the low elastic tip partial straight layer are disposed is formed in the tip portion of the golf club shaft.

10. The golf club shaft according to claim 8, wherein the tip partial bias layer includes a high elastic tip partial bias layer that has a fiber elastic modulus of greater than or equal to 33 t/mm$^2$, and a high elastic tip bias reinforced portion in which two or more plies of the high elastic tip partial bias layer are disposed is formed in the tip portion of the golf club shaft.

11. The golf club shaft according to claim 8, wherein the butt partial straight layer includes a high elastic butt partial straight layer that has a fiber elastic modulus of greater than or equal to 33 t/mm$^2$, and a high elastic butt straight reinforced portion in which one or more plies of the high elastic butt partial straight layer are disposed is formed in the butt portion of the golf club shaft.

12. The golf club shaft according to claim 8, wherein the tip partial straight layer includes a first tip partial straight layer that is longer than the tip partial bias layer, and a second tip partial straight layer that is longer than the first tip partial straight layer, the first tip partial straight layer has a thickness of less than or equal to 0.08 mm, and the second tip partial straight layer has a thickness of less than or equal to 0.08 mm.

* * * * *